US005542821A

United States Patent [19]

Dugan

[11] Patent Number: 5,542,821

[45] Date of Patent: Aug. 6, 1996

[54] PLATE-TYPE DIAPHRAGM PUMP AND METHOD OF USE

[75] Inventor: Jeffrey S. Dugan, Asheville, N.C.

[73] Assignee: BASF Corporation, Mount Olive, N.J.

[21] Appl. No.: 496,173

[22] Filed: Jun. 28, 1995

[51] Int. Cl.[6] ..... F04B 43/04

[52] U.S. Cl. ..... 417/53; 417/322; 417/413.2

[58] Field of Search ..... 417/322, 413.1, 417/413.2, 413.3, 53

[56] References Cited

U.S. PATENT DOCUMENTS

| | | | |
|---|---|---|---|
| 4,353,243 | 10/1982 | Martin | 73/23.1 |
| 4,828,219 | 5/1989 | Ohmi et al. | 251/118 |
| 4,869,282 | 9/1989 | Sittler et al. | 137/15 |
| 4,895,500 | 1/1990 | Hök et al. | 407/413.3 X |
| 5,029,805 | 7/1991 | Albarda et al. | 251/11 |
| 5,065,978 | 11/1991 | Albarda et al. | 251/129.06 |
| 5,083,742 | 1/1992 | Wylie et al. | 251/61.1 |
| 5,171,132 | 12/1992 | Miyazaki et al. | 417/322 X |
| 5,176,358 | 1/1993 | Bonne et al. | 251/30.05 |

*Primary Examiner*—Richard E. Gluck
*Attorney, Agent, or Firm*—Depaoli & Frenkel, P.C.

[57] ABSTRACT

A plate-type diaphragm pump is composed of an inlet valve member containing two inlet plate structures, an outlet valve member containing two outlet plate structures, and a diaphragm member preferably containing one or two plates, the plate structures being plates or plate sections. A first inlet plate structure has a first inlet channel section and a first valve-seat, a second inlet plate structure has a second inlet channel section and an inlet flexible element, a first outlet plate structure has a first outlet channel section and a second valve-seat, and a second outlet plate structure has a second outlet channel section and an outlet flexible element. The inlet and outlet flexible elements, respectively disposed between the inlet channel sections and the outlet channel sections, have free ends disposed for movement onto and off of the respective first and second valve-seats to respectively prevent or permit fluid flow between the respective inlet and outlet channel sections. The diaphragm member has a deflectable portion disposed for movement toward and away from a diaphragm-seat situated between the diaphragm member and the inlet and outlet channels to respectively prevent or permit fluid flow between the inlet and outlet channels. Movement of the free ends of the flexible elements and the deflectable portion of the diaphragm member may be magnetic-, pressure-, or temperature-induced.

40 Claims, 4 Drawing Sheets

PLATE-TYPE DIAPHRAGM PUMP AND METHOD OF USE

BACKGROUND OF THE INVENTION

This invention relates to a pump. More particularly, this invention relates to a plate-type diaphragm pump for controlling fluid flow.

Often, on/off and volume control of fluid flow is carried out by means of valve systems containing a diaphragm member to assist in flow control. Many conventional diaphragm-containing valve systems ("diaphragm pumps") are complex structures having a plurality of discrete parts and requiring precisely machined connections between the diaphragm member and the valve members. On the other hand, diaphragm pumps having a plate-like configuration have also been used to control fluid flow and are believed to have a simpler structure than the conventional diaphragm pumps with precisely machined parts. However, present plate-type diaphragm pumps can also have relatively complex structures and as such, can be expensive and time-consuming to make, clean and replace, and, thus, not offer sufficient advantages over the conventional diaphragm pumps. It is continually desirable to simplify the structure of plate-type diaphragm pumps.

Fluid-control plate-type pump systems are disclosed, for example, in U.S. Pat. Nos. 5,083,742; 4,353,243; 4,869,282; 5,176,358; 4,828,219; 5,029,805; and 5,065,978.

Conventional plate-type pumps, such as those described in the foregoing references, tend to be overly complicated structures containing numerous separately made parts. Substantial difficulty and expense can be encountered in trying to individually fabricate the pump members. The frequently bulky nature of prior plate-type pumps can make cleaning, inspecting and re-using the pumps difficult and time-consuming. Unfortunately, the costs associated with manufacturing such plate-type diaphragm pumps make disposal and replacement of the pumps an unattractive alternative. In addition, the conglomerate nature of the prior plate-type pumps tends to cause undesired wearing of the individual parts, thus requiring replacement of the worn parts. It would be desirable, therefore, to provide a plate-type diaphragm pump which is less expensive and less time consuming to make, inspect, clean, reuse and/or replace than prior plate-type diaphragm pumps.

Furthermore, none of the references recited hereinabove disclose a plate-type diaphragm pump which is capable of being actuated by a plurality of forces, e.g., fluid pressure, magnetic force and temperature change. It would be further desirable, therefore, to provide a plate-type diaphragm pump which is capable of being actuated by a plurality of forces such as those listed above.

A primary object of the present invention is to provide a plate-type diaphragm pump which is less bulky and less expensive to manufacture, inspect, clean, re-use and replace than prior plate-type diaphragm pumps.

A further object of the present invention is to provide a plate-type diaphragm pump which can be actuated by a plurality of actuating forces.

An additional object of the present invention is to provide a plate-type diaphragm pump which can be actuated by magnetic force, fluid pressure or temperature change.

A still further object of the present invention is to provide a method of controlling fluid flow by means of a plate-type diaphragm pump having the characteristics set forth in the preceding objects.

These and other objects which are achieved according to the present invention can be readily discerned from the following description.

SUMMARY OF THE INVENTION

One aspect of the present invention is directed to a plate-type diaphragm pump, containing:

an inlet valve-member containing: a first inlet plate containing a first valve-seat and an integral first section of an inlet channel; and a second inlet plate containing an integral second section of the inlet channel and a flexible inlet element disposed between the sections of the inlet channel, the inlet element having a free end disposed to move off of and onto the first valve-seat to respectively allow and prevent fluid flow through the inlet channel;

an outlet valve-member containing: a first outlet plate containing a second valve-seat and an integral first section of an outlet channel; and a second outlet plate containing an integral second section of the outlet channel and a flexible outlet element disposed between the sections of the outlet channel, the outlet element having a free end disposed to move off of and onto the second valve-seat to respectively allow and prevent fluid flow through the outlet channel; and a diaphragm member having a deflectable portion disposed for movement toward and away from a diaphragm-seat situated in a fluid chamber disposed between the diaphragm member and the inlet and outlet channels.

A second aspect of this invention is directed to a method of controlling fluid flow by means of the plate-type pump of this invention. Generally, the method of this invention involves the steps of:

introducing a first fluid into the first section of the inlet channel; and inducing a first actuating force sufficient to cause: the deflectable portion of the diaphragm member to move away from the diaphragm-seat, the free end of the flexible inlet element to move off of the first valve-seat, and the free end of the flexible outlet element to move onto the second valve-seat, so as to cause the first fluid to flow through the inlet channel and into the fluid chamber; and inducing a second actuating force sufficient to cause: the deflectable portion of the diaphragm member to move toward the diaphragm-seat, the free end of the flexible inlet element to move onto the first valve-seat, and the free end of the flexible outlet element to move off of the second valve-seat, so as to cause the first fluid to flow from the fluid chamber through the outlet channel.

The actuating force can include fluid pressure, magnetic force, temperature change or a combination of the foregoing.

The various parts of the pump of this invention are preferably formed from 1 to 5, more preferably from 3 to 4, basic plate bodies. For example, in one preferred embodiment, the pump of this invention is composed of a pair of inlet plates, a pair of outlet plates and one or two diaphragm plates in which the flexible diaphragm member is formed. In another preferred embodiment, the pump is composed of a pair of inlet/outlet plates and one or two diaphragm plates. The diaphragm member may be formed in a single diaphragm plate or in a composite diaphragm member composed of two flexible plates fused together.

Thus, the pump of this invention can be quickly made, with no need for individual discrete assembly. In addition, the diaphragm pump of this invention tends to be less bulky and less expensive to manufacture, inspect, clean, re-use and replace than prior diaphragm pumps.

A further benefit offered by the diaphragm pump of this invention is that the pump can be manufactured as part of a larger system, e.g., a filter, a heat exchanger, a static mixer and the like, wherein the larger system (including the pump therein) can be manufactured relatively simply and economically in a single step. Thus, with the present invention, a complete system can be made by means of a single manufacturing process.

DETAILED DESCRIPTION OF THE INVENTION

Figure 1:
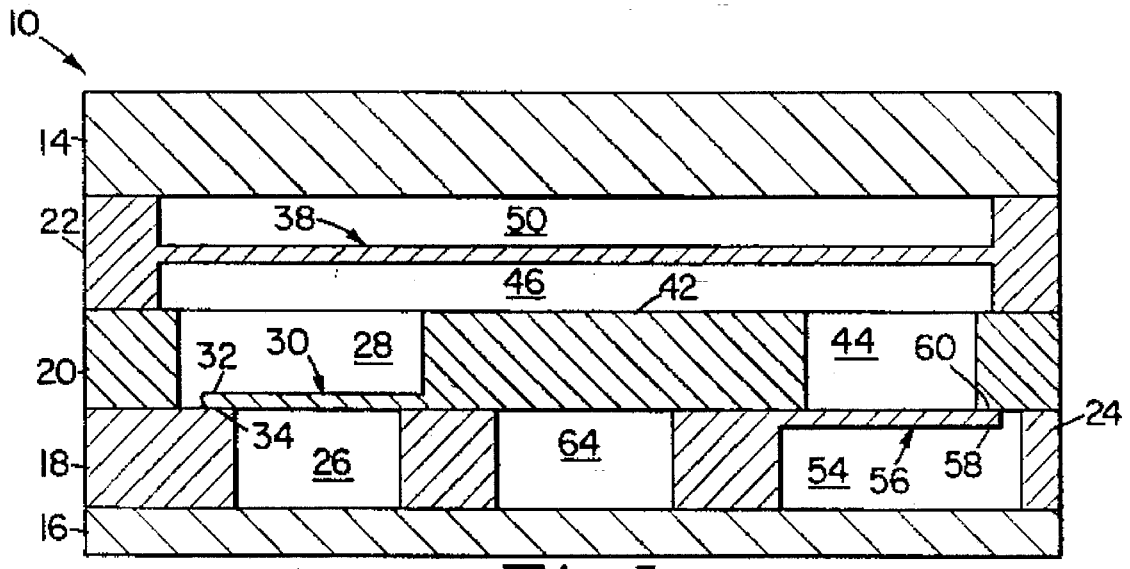
FIG. 1 is a cross-sectional side view of a first embodiment of a plate-type diaphragm pump of the present invention, wherein the plate-type diaphragm pump is fully magnetic-actuated.

The plate-type diaphragm pump of this invention contains an inlet valve member, an outlet valve member and a diaphragm member. The inlet valve member may contain first and second inlet plates and the outlet valve member may be composed of first and second outlet plates. Alternatively, the second inlet plate and the first outlet plate constitute a first single inlet/outlet plate and/or the first inlet plate and the second outlet plate constitute a second single inlet/outlet plate.

The diaphragm member is formed in at least one diaphragm plate and preferably is formed in one or two diaphragm plates. In pressure-actuated and magnetic-actuated embodiments of the pump of this invention, the diaphragm member is preferably composed of a single diaphragm element formed in a single diaphragm plate. In temperature-actuated embodiments of the pump of this invention, the diaphragm member is preferably formed in two diaphragm plates laminated together, wherein the diaphragm member is a composite containing a first diaphragm element formed in the first diaphragm plate and a second diaphragm element formed in the second diaphragm plate. In an alternative embodiment of the diaphragm member used in a temperature-actuated pump within the scope of this invention, the diaphragm member is formed in a single plate and is composed of a composite containing a first diaphragm element and a second diaphragm element laminated together, wherein the first diaphragm element is integral with (i.e., formed in) the diaphragm plate while the second diaphragm element is non-integral to the diaphragm plate but rather is a film bonded or plated to the underside surface of the first diaphragm element.

Preferably, the pump of this invention further contains a first end-plate and a second end-plate, wherein the first end-plate is disposed on the diaphragm plate or over the diaphragm member if no diaphragm plate is used, while the second end-plate is disposed on the first inlet plate and second outlet plate or on the second inlet/outlet plate.

In the pump of this invention, the inlet valve member contains an inlet channel while the outlet valve member contains an outlet channel. The inlet channel is in the form of two channel sections, wherein a first section is formed in the first inlet plate or second inlet/outlet plate, while a second section is formed in the second inlet plate or first inlet/outlet plate. The outlet channel is also in the form of two channel sections, wherein a first section is formed in the first outlet plate or first inlet/outlet plate, and the second section is formed in the second outlet plate or second inlet/outlet plate.

In addition, the inlet and outlet valve members contain respective flexible inlet and outlet elements and respective first and second valve-seats.

The flexible inlet element is disposed in the second inlet plate or first inlet/outlet plate, while the first valve-seat is situated in the first inlet plate or in the second inlet/outlet plate. The flexible inlet element is situated between the first and second sections of the inlet channel and has a free end which is disposed for movement onto and off of the first valve-seat. Movement of the inlet element onto the first valve-seat prevents fluid flow through the inlet channel (i.e., between the inlet channel sections) and thereby "closes" the inlet valve member. Movement of the inlet element off of the first valve-seat permits fluid flow through the inlet channel and thereby "opens" the inlet valve member.

The flexible outlet element is disposed in the second outlet plate or second inlet/outlet plate, and the second valve-seat is situated in the first outlet plate or in the first inlet/outlet plate. The flexible outlet element is located between the first and second sections of the outlet channel and has a free end which is disposed for movement onto and off of the second valve-seat. When the outlet element is moved onto the second valve-seat, fluid flow through the outlet channel (i.e., between the outlet channel sections) is prevented, and the outlet valve member is thereby closed. Movement of the outlet element off of the second valve-seat permits fluid flow through the outlet channel and thereby "opens" the outlet valve member.

The width of the first inlet channel section is preferably less than the width of the flexible inlet element. Likewise, the width of the first outlet channel section is preferably less than the width of the flexible outlet element. In addition, the first and second valve-seats may each contain a raised lip into which the respective free ends of the inlet and outlet elements can be seated to further seal the second inlet channel section from the first inlet channel section and the second outlet channel section from the first outlet channel section.

The diaphragm member has a deflectable portion which is disposed for movement toward and away from a diaphragm-seat situated in the fluid chamber. The diaphragm-seat is preferably a section of the first inlet/outlet plate, second inlet plate or first outlet plate. The diaphragm-seat is disposed between the second inlet channel section and the first outlet channel section.

In the pump of this invention, a fluid chamber is disposed between the diaphragm member and the inlet and valve members. The fluid chamber is disposed between and in fluid communication with the inlet and outlet channels. In some embodiments, the pump of this invention may contain two fluid chambers which are separated from one another by the diaphragm member.

Preferably, the fluid chamber, as well as the diaphragm member, is formed in at least one diaphragm plate. A diaphragm-seat is situated in the fluid chamber. The deflectable portion is disposed to move toward and away from the diaphragm-seat, as discussed in greater detail hereinbelow. Preferably, a section of the first inlet/outlet plate or a section taken from one or both of the second inlet plate and the first outlet plate makes up the diaphragm-seat.

The inlet and outlet valve members and the diaphragm member of the pump of this invention may be "actuated" (i.e., opened and/or closed) by means of a variety of actuating forces including magnetic force, fluid pressure, temperature change, and a combination of the foregoing.

In preferred embodiments of a fully pressure-actuated pump within the scope of this invention, the pump is composed of first and second end-plates, a single diaphragm plate, and first and second inlet/outlet plates. In a pressure-actuated pump, when the diaphragm member is disposed in a flat or stable position (as shown, e.g., in FIG. 1), the pressure between inlet and outlet valve members must be equal to or greater than the inlet pressure and equal to or less than the outlet pressure to prevent leakage from the pump. As the diaphragm member moves away from the diaphragm-seat (as shown, e.g., in FIG. 2), the pressure between the inlet and outlet valve members is reduced, leading to a pressure imbalance which forces the inlet valve member open and the outlet valve member closed. As the diaphragm member is moved toward the diaphragm-seat, the pressure between the inlet and outlet valve members is increased, leading to another pressure imbalance which forces the inlet valve member closed and the outlet valve member open.

Thus, to open the inlet valve member and close the outlet valve member in the pressure-actuated pump, the deflectable portion of the diaphragm member is moved away from the diaphragm-seat so as to decrease the pressure between the inlet and outlet valve members such that the pressure tending to push the free end of the flexible inlet element away from the first valve-seat is greater than the pressure tending to push the free end onto the first valve-seat. At the same time, the pressure tending to push the free end of the flexible outlet element away from the second valve-seat is less than the pressure tending to push the free end onto the second valve-seat. To close the inlet valve member and open the outlet valve member, the deflectable portion of the diaphragm member is moved toward the diaphragm-seat so as to increase the pressure between the inlet and outlet valve members such that the pressure tending to push the free end of the flexible inlet element away from the first valve-seat is less than the pressure tending to push the free end onto the first valve-seat. At the same time, the pressure tending to push the free end of the flexible outlet element away from the second valve-seat is greater than the pressure tending to push the free end onto the second valve-seat.

Fluids which can be used as to effect a pressure force in the present invention include gases, such as inert gas, e.g., argon, helium, nitrogen, carbon dioxide, compressed air or any other gas conventionally used in valve or diaphragm control. Preferably, the fluid used to effect pressure forces in the present invention is preferably an incompressible liquid, thus permitting the transmission of pressure fluctuations more rapidly and more efficiently. The fluid can be provided from any convenient source, e.g., a fluid cylinder.

Figure 2:
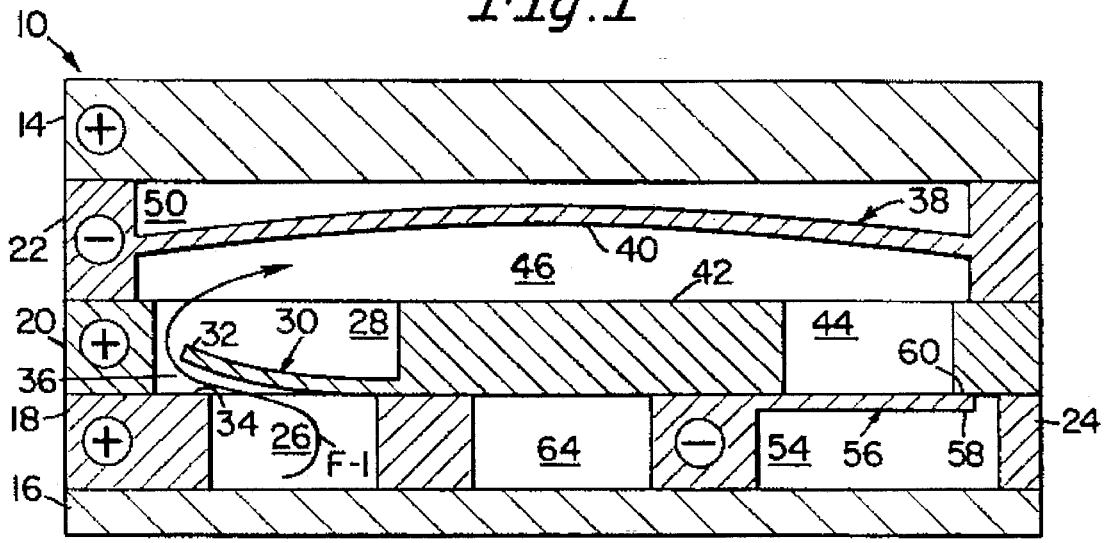
FIG. 2 is a first cross-sectional side view of the fully magnetic-actuated diaphragm pump shown in FIG. 1, wherein the inlet valve member and the diaphragm member are each open and the outlet valve member is closed.
Figure 3:
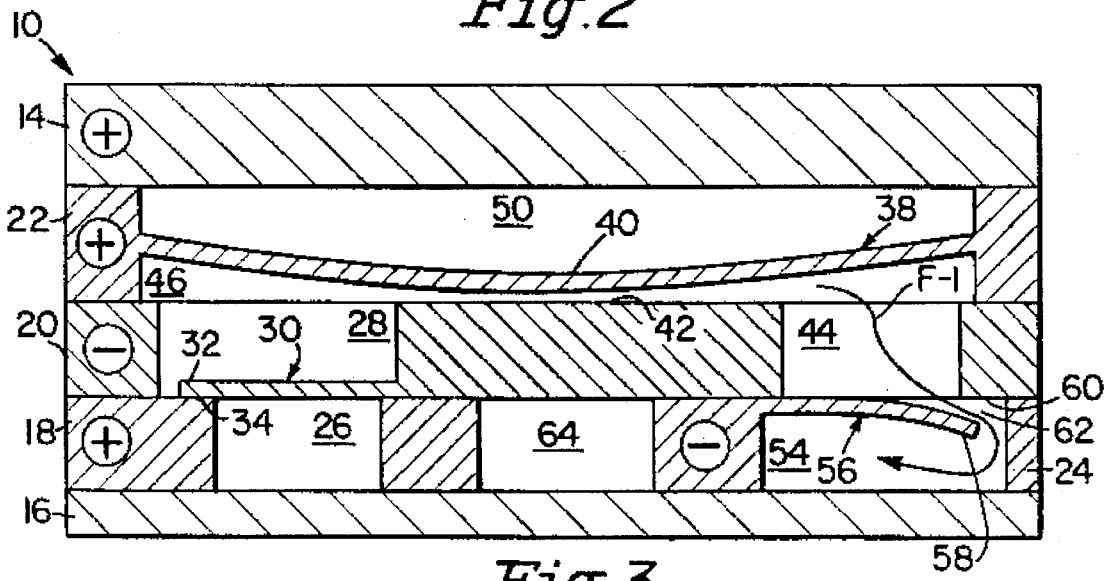
FIG. 3 is a second cross-sectional side view of the fully magnetic-actuated diaphragm pump shown in FIG. 1, wherein the inlet valve member and the diaphragm member are each closed and the outlet valve member is open.

In fully magnetic-actuated embodiments of the pump of this invention, the pump is preferably composed of the first and second end-plates described previously herein, the first inlet plate, the second outlet plate, the first inlet/outlet plate, and a single diaphragm plate (see, e.g., FIGS. 1–3). Each of the plates will be composed of a permanently or reversibly charged material.

In one method of opening the inlet valve member and closing the outlet valve member in the fully magnetic-actuated embodiment of the pump of this invention, the first end-plate and the diaphragm plate are charged to opposite polarities; the at least one diaphragm plate and the first inlet/outlet plate are charged to opposite polarities; the first inlet plate and the first inlet/outlet plate are charged to like polarities; and the first inlet/outlet plate and the second outlet plate are charged to opposite polarities. In this embodiment, the attraction between the diaphragm plate and the first inlet/outlet plate and the repulsion between the first inlet plate and the first inlet/outlet plate cause the free end of the flexible inlet element to move away from the first valve-seat to thereby open the inlet valve member. The attraction between the first end-plate and the diaphragm plate will cause the deflectable portion of the diaphragm member to move away from the diaphragm-seat. The attraction between the first inlet/outlet plate and the second outlet plate causes the free end of the flexible outlet element to move onto the second valve-seat to thereby close the outlet valve member.

To close the inlet valve member and open the outlet valve member in this embodiment of a fully magnetic-actuated pump within the scope of this invention, the first end-plate and the diaphragm plate are charged to like polarities; the diaphragm plate and the first inlet/outlet plate are charged to opposite polarities; the first inlet plate and the first inlet/outlet plate are charged to opposite polarities; and the first inlet/outlet plate and the second outlet plate are charged to like polarities. In this embodiment, the attraction between the diaphragm plate and the first inlet/outlet plate and the attraction between the first inlet plate and the first inlet/outlet plate cause the free end of the flexible inlet element to move onto the first valve-seat to thereby close the inlet valve member. The repulsion between the first inlet/outlet plate and the second outlet plate causes the free end of the flexible outlet element to move away from the second valve-seat, thereby opening the outlet valve member. The repulsion between the first end-plate and the diaphragm plate will cause the deflectable portion of the diaphragm member to move toward the diaphragm-seat which further causes the inlet valve member to close and the outlet valve member to open.

The pump of this invention may also be actuated by a combination of actuating forces. For example, the pump may be partially magnetic-actuated and partially pressure-actuated. Preferably, in this embodiment, the pump will be composed of the same plates as used in the fully magnetic-actuated embodiments described above, except that, instead of the first inlet plate and the second outlet plate, the pump contains a second inlet/outlet plate. In one particularly preferred embodiment of the magnetic/pressure-actuated pump, the first end-plate and the diaphragm plate are charged to opposite polarities. This causes the deflectable portion of the diaphragm member to move away from the diaphragm-seat which in turn causes the pressure in the fluid chamber to decrease such that the pressure tending to push the free end of the flexible inlet element onto the first valve-seat to be less than the pressure tending to cause the free end to move away from the first valve-seat. Thus, the inlet valve member is opened in this embodiment. At the same time, the movement of the deflectable portion away from the diaphragm-seat causes the pressure tending to push the free end of the flexible outlet element onto the second valve-seat to be greater than the pressure tending to cause the free end to move away from the second valve-seat. Thus, the outlet valve member is closed.

To close the inlet valve member and open the outlet valve member in this embodiment of a magnetic/pressure-actuated pump, the first end-plate and the diaphragm plate are charged to like polarities. This causes the deflectable portion of the diaphragm member to move toward the diaphragm-seat which in turn causes the pressure in the fluid chamber to increase such that the pressure tending to cause the free end of the flexible inlet element to rest upon the first valve-seat is greater than the pressure tending to cause the free end to move away from the first valve-seat. At the same time, the pressure tending to cause the free end of the flexible outlet element to move away from the second valve-seat will be greater than the pressure tending to cause the free end to move onto the second valve-seat. Thus, the inlet valve member is closed and the outlet valve member is opened.

In pressure-actuated, magnetic-actuated, or pressure/magnetic-actuated embodiments of the pump of this invention, the diaphragm member is preferably formed in a single diaphragm plate. In temperature-actuated embodiments of the pump, the diaphragm member is preferably a composite composed of two diaphragm elements laminated together, wherein the diaphragm elements are formed from different diaphragm plates. A first diaphragm element has a first thermal expansion coefficient and a second diaphragm element has a second thermal expansion coefficient, the first and second thermal expansion coefficients being different from one another. If the diaphragm elements are maintained at a first temperature wherein both elements have identical dimensions, the deflectable portion of the composite diaphragm member will be disposed in a flat or "stable" position. However, if either or both of the diaphragm elements are heated or cooled, the different thermal expansion coefficients of the materials making up the elements will cause the deflectable portion of the composite diaphragm member to be deflected toward one direction or the other to either open or close the diaphragm member.

Preferably, one or more heat exchange channels are formed in the composite diaphragm member used in the temperature-actuated embodiment of the pump of this invention. A heat exchange fluid is passed through the heat exchange channel(s) to facilitate heating or cooling of the composite diaphragm member to cause the deflectable portion of the member to move toward and away from the diaphragm-seat. The use of heat exchange channels and heat exchange fluids to cause heating or cooling provides greater control over the temperature, and therefore over the operation, of the temperature-actuated pump.

To maintain the composite diaphragm member in a flat or "stable" position, the first and second diaphragm elements making up the composite diaphragm member are maintained at a temperature wherein both elements have identical dimensions. To move the deflectable portion of the composite diaphragm member away from or toward the diaphragm-seat, either or both of the diaphragm elements are heated or cooled, whereby the different thermal expansion coefficients of the materials making up the elements cause the composite diaphragm member to be deflected toward one direction or the other. For example, if the first diaphragm element ends up with more expansion or less contraction than the second diaphragm element in response to a change in temperature, the deflectable portion is deflected away from the diaphragm-seat. On the other hand, if the first diaphragm element ends up with more expansion or less contraction than the second diaphragm element in response to a change in temperature, the deflectable portion of the composite diaphragm member is deflected toward the diaphragm-seat.

The movement of the deflectable portion of the composite diaphragm member away from the diaphragm-seat reduces the pressure between the inlet and outlet valve members, causing a pressure imbalance which forces the free end of the flexible inlet element to move away from the first valve-seat and the free end of the flexible outlet element to move onto the second valve-seat. Thus, in this embodiment, a fluid is permitted to flow from the first inlet channel section to the second inlet channel section and then into a fluid chamber disposed between the composite diaphragm member and the inlet and outlet plates.

Movement of the deflectable portion of the composite flexible member toward the diaphragm-seat increases the pressure between the inlet and outlet valve members, causing a pressure imbalance which forces the free end of the flexible inlet element to move onto the first valve-seat and the free end of the flexible outlet element to move off of the second valve-seat. Thus, in this embodiment, a fluid is permitted to flow from the fluid chamber through the outlet channel.

In temperature-actuated embodiments of the pump of this invention wherein the diaphragm member is a composite diaphragm member as described hereinabove and further wherein the diaphragm member constitutes the only portion of the pump which is actuated by temperature, the pump is a "partially" temperature-actuated pump. In alternative embodiments of the pump, either or both of the flexible inlet element and the flexible outlet element is composed of a composite containing a first sub-element and a second sub-element laminated together in a face-to-face configuration, wherein the first sub-element contains a first material having a first thermal expansion coefficient, and the second sub-element contains a second material having a second thermal expansion coefficient. Thus, the inlet and/or outlet element would be a "composite" inlet and/or outlet element and would be temperature-actuated in the same manner as described hereinabove in connection with the composite diaphragm member. In addition, heat exchange channels can be formed in the composite inlet element or composite outlet element. Preferably, the composite element is formed in two element-plates, such that the first sub-element is integral with a first element-plate and the second subelement is integral with the second element-plate. Where the diaphragm member and the inlet and outlet flexible elements are each composites which are temperature-actuated, the pump is a "fully" temperature-actuated pump.

In preferred pressure-actuated, magnetic-actuated, and pressure/magnetic-actuated embodiments of the pump of this invention, the flexible inlet and outlet elements are cantilevered on the respective inlet and outlet plates. In the temperature-actuated embodiments of the pump of this invention, the first diaphragm element of the composite diaphragm member is preferably cantilevered onto the first diaphragm plate and the second diaphragm element of the composite diaphragm member is preferably cantilevered onto the second diaphragm plate.

The material used in the plates will depend on the particular actuating force used to open or close the inlet, outlet and diaphragm members.

When the actuating force is fluid pressure, the valve-member plates can be composed of any flexible metal or non-metal, preferably metal. The diaphragm member is preferably formed of an elastomeric material.

When the actuating force is magnetic force, the plates can be made of any material, preferably a metal or metal alloy, which is capable of being permanently or reversibly charged to a negative or positive polarity, so long as the metal or metal alloy is flexible. Non-metals rendered magnetic by chemical structure or by the inclusion of magnetic additives can also be used.

When the actuating force is temperature change, the plates are composed of materials, preferably metals or metal alloys, having different thermal expansion coefficients. Examples of suitable metals and metal alloys for use in the temperature-actuated embodiments of the pump of this invention include iron, copper, chromium, tungsten, carbon-manganese alloys, chromium-molybdenum alloys, chromium-tungsten alloys, aluminum-based alloys (e.g., aluminum nickel cobalt alloys), iron-nickel alloys, and various grades of cobalt steel (including cobalt-chromium and cobalt-tungsten), stainless steel, aluminum, nickel, copper-based alloys, mild steel, brass, titanium and other micromachinable metals.

Preferably, the plates are composed of a flexible material which is inert to the fluid stream passing through the channels in the plates. Because of its inertness and the relatively low cost associated with its use, stainless steel is a particularly useful metal in the pump of this invention.

In the pump of this invention, the inlet and outlet valve members, the diaphragm member, the inlet and outlet channels, the fluid chamber are preferably formed by a micromachining process. Also preferably, the first and second valve-seats, the diaphragm-seat and, if present, the heat exchange channel(s), are formed by a micromachining process. Non-limiting examples of suitable micromachining processes include etching, stamping, punching, pressing, cutting, molding, milling, lithographing, and particle blasting. Most preferably, if the plates which are to be micromachined are composed of metals, the micromachining process comprises an etching process. Etching, e.g., photochemical etching, provides precisely formed parts and channels while being less expensive than many other conventional machining processes. Furthermore, etched perforations generally do not have the sharp corners, burrs, and sheet distortions associated with mechanical perforations. Etching processes are well known in the art and are typically carried out by contacting a surface with a conventional etchant.

If the plates which are to be micromachined are not formed of metal, the preferred micromachining process will not be etching but rather molding.

The plates used in the pump of this invention are preferably thin. For example, the plates can each be as thin as 0.001 inch. More preferably, the plates each have a thickness of from about 0.001 inch to about 1.0 inch and most preferably from about 0.01 inch to about 0.10 inch.

The flexible inlet and outlet elements and the diaphragm member each have a thickness preferably ranging from about 10% to about 80%, more preferably from about 10% to about 50%, and most preferably ranging from about 10% to about 25%, of the thickness of the respective plates in which the inlet and outlet elements and the diaphragm member are formed.

As stated previously herein, the present invention is further directed to a method of controlling fluid flow by means of the plate-type diaphragm pump of this invention. Generally, the method of this invention involves the steps of:

introducing a first fluid into the first section of the inlet channel; and inducing a first actuating force sufficient to cause: the deflectable portion of the diaphragm member to move away from the diaphragm-seat, the free end of the flexible inlet element to move off of the first valve-seat, and the free end of the flexible outlet element to move onto the second valve-seat, so as to cause the first fluid to flow through the inlet channel and into the fluid chamber; and inducing a second actuating force sufficient to cause: the deflectable portion of the diaphragm member to move toward the diaphragm-seat, the free end of the flexible inlet element to move onto the first valve-seat, and the free end of the flexible outlet element to move off of the second valve-seat, so as to cause the first fluid to flow from the fluid chamber through the outlet channel.

In the pressure-actuated embodiment of the pump of this invention, the first and second actuating forces each comprise pressure. The first actuating force involves a first pressure which is exerted against the deflectable portion to cause the portion to move away from the diaphragm-seat. This movement of the deflectable portion produces a second pressure which is exerted against the free end of the flexible inlet element to cause this element to move away from the first valve-seat. The movement of the deflectable portion away from the diaphragm-seat also generates a third pressure which is exerted against the free end of the flexible outlet element to cause the free end to move onto the second valve-seat. The second actuating force involves a first pressure which is exerted against the deflectable portion to cause the portion to move toward the diaphragm-seat. This movement of the deflectable portion produces a second pressure which is exerted against the free end of the flexible inlet element to cause the free end to move onto the first valve-seat. In addition, the movement of the deflectable portion produces a third pressure which is exerted against the free end of the flexible outlet element to cause the free end to move away from the second valve-seat.

In the magnetic-actuated embodiment of the pump of this invention, the first and second actuating forces each comprise magnetic force. The first actuating force involves a first magnetic force which causes the deflectable portion to move away from the diaphragm-seat, a second magnetic force which causes the free end of the inlet element to move away from the first valve-seat, and a third magnetic force which causes the free end of the outlet element to move onto the second valve-seat. The second actuating force involves a first magnetic force which causes the deflectable portion to move toward the diaphragm-seat, a second magnetic force which causes the free end of the inlet element to move onto the first valve-seat, and a third magnetic force which causes the free end of the outlet element to move away from the second valve-seat.

In the temperature-actuated embodiment of the pump of this invention, the first and second actuating forces each comprise temperature change. As mentioned previously herein, the diaphragm member is a composite containing a first diaphragm element and a second diaphragm element laminated together. The first diaphragm element is formed of a first material having a first thermal expansion coefficient and the second diaphragm element is formed of a second material having a second thermal expansion coefficient which is different from the first thermal expansion coefficient. At one temperature, the diaphragm elements are maintained at a temperature wherein both elements have identical dimensions and the deflectable portion is disposed in a flat or "stable" position. The first actuating force involves a first temperature change induced by heating or cooling the diaphragm member, wherein the different thermal expansion coefficients of the materials making up the elements cause diaphragm composite member to be deflected away from the diaphragm-seat. This in turn generates a first pressure which causes the free end of the inlet element to move away from the first valve-seat and a second pressure which causes the free end of the outlet element to move onto the second valve-seat. The second actuating force involves a second temperature change induced by heating or cooling the diaphragm member which causes the deflectable portion of the diaphragm member to move toward the diaphragm-seat, which in turn generates a first pressure which causes the free end of the inlet element to move onto the first valve-seat and a second pressure which causes the free end of the outlet element to move away from the second valve-seat.

The pump and method of this invention can be described more fully by reference to FIGS. 1–10 herein.

FIGS. 1–3 illustrate a first embodiment of a plate-type diaphragm pump within the scope of this invention, wherein the diaphragm pump is fully magnetic-actuated. FIGS. 2 and 3 respectively show first and second cross-sectional side views of the pump illustrated in FIG. 1. In FIG. 2, the inlet valve member is open and the outlet valve member is closed, whereas, in FIG. 3, the inlet valve member is closed and the outlet valve member is open.

In FIGS. 1–3, pump 10 is composed of a first inlet plate 18, a first inlet/outlet plate 20, a diaphragm plate 22, a second outlet plate 24, a first end-plate 14 and a second end-plate 16. Plates 18 and 24 are separated from one another by a spaced gap 64.

First inlet-plate 18 has formed therein a first section 26 of an inlet channel 26/28 and a first valve-seat 34. First inlet/outlet plate 20 has formed therein a second section 28 of inlet channel 26/28 and a flexible inlet element 30 having a free end 32. First inlet/outlet plate 20 further has formed therein a first section 44 of an outlet channel 44/54 and a second valve-seat 60. Second outlet plate 24 has formed therein a second section 54 of outlet channel 44/54 and a flexible outlet element 56 having a free end 58. Pump 10 further contains a diaphragm member 38 which is formed in a diaphragm plate 22. Diaphragm member has a deflectable portion 40 which is disposed for movement toward and away from a diaphragm-seat 42 which is a section of first inlet/outlet plate 20. Also formed in diaphragm plate 22 are two fluid chambers 46 and 50 which are separated from one another by diaphragm member 38. Chamber 46 is disposed between diaphragm member 38 and first inlet/outlet plate 20, while chamber 50 is disposed between diaphragm member 38 and first end-plate 14. Diaphragm-seat 42 is disposed in chamber 46 and preferably comprises the upper facial surface of plate 20.

First and second valve-seats 34 and 60 preferably comprise the upper facial surface of plates 18 and 24, respectively.

In FIGS. 1–3, the first and second inlet channel sections 26 and 28, the flexible inlet element 30 and free end 32, and first valve-seat 34 make up an inlet valve member; while the first and second outlet channel sections 44 and 54, the flexible outlet element 56 and free end 58, and second valve-seat 60 make up an outlet valve member.

Free end 32 of flexible inlet element 30 is disposed for movement onto and off of first valve-seat 34. When free end 32 is disposed off of first valve-seat 34 (as shown, e.g., in FIG. 2), flow of a fluid F-1 between inlet channel sections 26 and 28 is permitted via a passageway 36 and the inlet valve member is said to be in an "open" position. When free end 32 is disposed on first valve-seat 34 (as shown, e.g., in FIG. 3), fluid flow between inlet channel sections 26 and 28 is prevented and the inlet valve member is said to be in a "closed" position. Free end 58 of flexible outlet element 56 is disposed for movement onto and off of second valve-seat 60. When free end 58 is disposed off of second valve-seat 60 (as shown, e.g., in FIG. 3), fluid flow between outlet channel sections 44 and 54 is permitted via a passageway 62 and the outlet valve member is said to be in an "open" position. When free end 58 is disposed on second valve-seat 60 (as shown, e.g., in FIG. 2), fluid flow between outlet channel sections 44 and 54 is prevented and the outlet valve member is said to be in a "closed" position.

In FIG. 2, plates 14 and 22 are charged to opposite polarities; plates 20 and 22 are charged to opposite polarities; plates 18 and 20 are charged to like polarities; and plates 24 and 20 are charged to opposite polarities. The opposite polarities of plates 20 and 24 cause free end 58 of flexible outlet element 56 to rest upon valve-seat 60. The opposite polarities of plates 14 and 22 cause deflectable portion 40 of diaphragm member 38 to move away from diaphragm-seat 42. The opposite polarities of plates 20 and 22 and the like polarities of plates 18 and 22 cause free end 32 of flexible inlet element 30 to move off of valve-seat 34. Thus, in the pump shown in FIG. 2, the inlet valve member is open and the outlet valve member is closed, and fluid F-1 is caused to flow from channel section 26 to channel section 28 and into fluid chamber 46.

In FIG. 3, plates 14 and 22 are charged to like polarities; plates 20 and 22 are charged to opposite polarities; plates 18 and 20 are charged to opposite polarities; and plates 24 and 20 are charged to like polarities. The like polarities of plates 20 and 24 cause free end 58 of flexible outlet element 56 to move away from valve-seat 60. The like polarities of plates 14 and 22 cause deflectable portion 40 of diaphragm member 38 to move toward diaphragm-seat 42. The opposite polarities of plates 20 and 22 and the opposite polarities of plates 18 and 20 cause free end 32 of flexible inlet element 30 to move onto valve-seat 34. Thus, in the pump shown in FIG. 3, the inlet valve member is closed and the outlet valve member is open, and fluid F-1 is caused to flow from chamber 46 through outlet channel sections 44 and 54.

Figure 4:
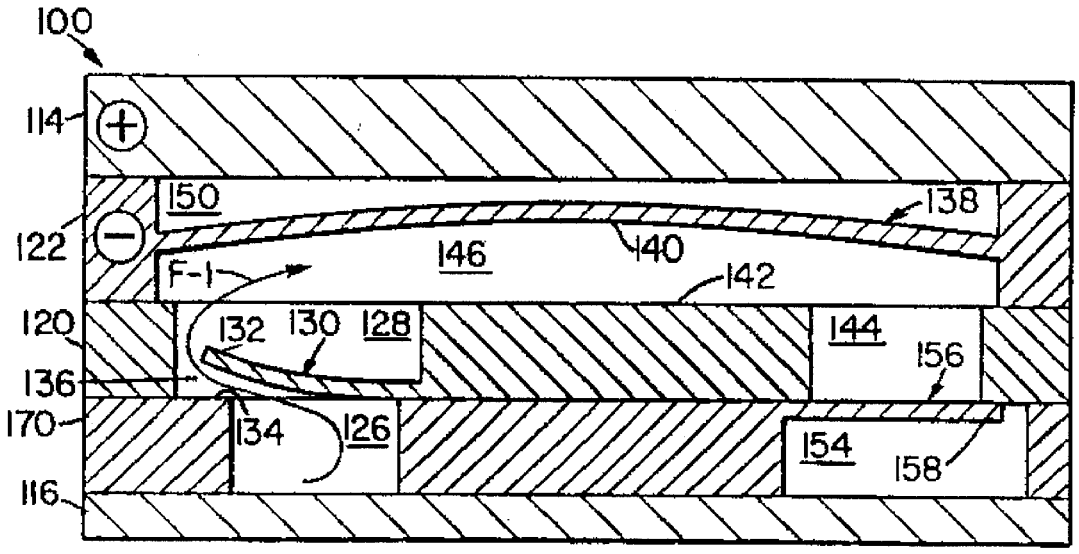
FIG. 4 is a first cross-sectional side view of a second embodiment of a plate-type diaphragm pump of the present invention, wherein the plate-type diaphragm pump is magnetic- and pressure-actuated, further wherein, in the view shown in FIG. 4, the inlet valve member and the diaphragm member are each open and the outlet valve member is closed.
Figure 5:
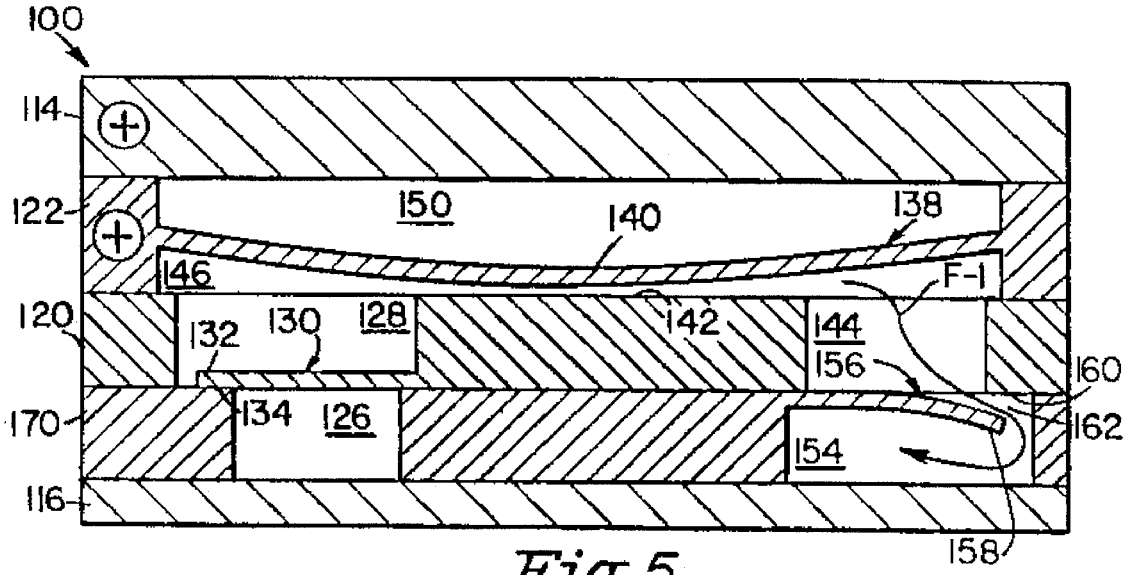
FIG. 5 is a second cross-sectional side view of the diaphragm pump shown in FIG. 4, wherein the inlet valve member and the diaphragm member are each closed and the outlet valve member is open.

FIGS. 4 and 5 illustrate a magnetic/pressure-actuated pump within the scope of the present invention, wherein the inlet valve member of the pump is open in FIG. 4 and closed in FIG. 5, and the outlet valve member is closed in FIG. 4 and open in FIG. 5.

In FIGS. 4 and 5, pump 100 contains first and second end-plates 114 and 116, a first inlet/outlet plate 120, a second inlet/outlet plate 170, and a diaphragm plate 122. Second inlet/outlet plate 170 has formed therein a first section 126 of an inlet channel 126/128 and a first valve-seat 134. First inlet/outlet plate 120 has formed therein a second section 128 of inlet channel 126/128 and a flexible inlet element 130 having a free end 132. First inlet/outlet plate 120 further has formed therein a first section 144 of an outlet channel 144/154 and a second valve-seat 160. Second inlet/outlet plate 170 further has formed therein a second section 154 of outlet channel 144/154 and a flexible outlet element 156 having a free end 158.

Pump 100 further contains a diaphragm member 138 which is formed in a diaphragm plate 122. Diaphragm member has a deflectable portion 140 which is disposed for movement toward and away from a diaphragm-seat 142 which is a section of first inlet/outlet plate 120. Also formed in diaphragm plate 122 are two fluid chambers 146 and 150 which are separated from one another by diaphragm member 138. Chamber 146 is disposed between diaphragm member 138 and first inlet/outlet plate 120, while chamber 150 is disposed between diaphragm member 138 and first end-plate 114. Diaphragm-seat 142 is disposed in chamber 146 and preferably comprises the upper facial surface of plate 120.

First and second valve-seats 134 and 160 preferably comprise sections of the upper facial surface of plate 170.

In FIGS. 4 and 5, the first and second inlet channel sections 126 and 128, the flexible inlet element 130 and free end 132, and first valve-seat 134 make up an inlet valve member; while the first and second outlet channel sections 144 and 154, the flexible outlet element 156 and free end 158, and second valve-seat 160 make up an outlet valve member.

Free end 132 of flexible inlet element 130 is disposed for movement onto and off of first valve-seat 134. When free end 132 is disposed off of first valve-seat 134 (as shown, e.g., in FIG. 4), flow of a fluid F-1 between inlet channel sections 126 and 128 is permitted via a passageway 136. When free end 132 is disposed on first valve-seat 134 (as shown, e.g., in FIG. 5), fluid flow between inlet channel sections 126 and 128 is prevented. Free end 158 of flexible outlet element 156 is disposed for movement onto and off of second valve-seat 160. When free end 158 is disposed off of second valve-seat 160 (as shown, e.g., in FIG. 3), fluid flow between outlet channel sections 144 and 154 is permitted via a passageway 162. When free end 158 is disposed on second valve-seat 160 (as shown, e.g., in FIG. 4), fluid flow between outlet channel sections 144 and 154 is prevented.

In FIG. 4, end-plate 114 and diaphragm plate 122 are charged to opposite polarities, which causes the deflectable portion 140 to be attracted toward end-plate 114 and away from diaphragm-seat 142. The movement of deflectable portion 140 away from diaphragm-seat 142 reduces the pressure between the inlet and outlet valve members and permits the free end 132 of inlet element 130 to be moved off of first valve-seat 134 by means of fluid F-1 which then flows via passageway 136 from channel section 126 to channel section 128 and into chamber 146.

In FIG. 5, end-plate 114 and diaphragm plate 122 are charged to like polarities, which causes the deflectable portion 140 to be repelled from end-plate 114 and attracted toward diaphragm-seat 142. The movement of deflectable portion 140 toward diaphragm-seat 142 causes the free end 132 of inlet element 130 to move onto the first valve-seat 134 and the free end 158 of deflectable portion 156 to move off of second valve-seat 160. Thus, as shown in FIG. 5, fluid F-1 is forced from chamber 146 and through outlet channel sections 144 and 154 through passageway 162.

Figure 6:
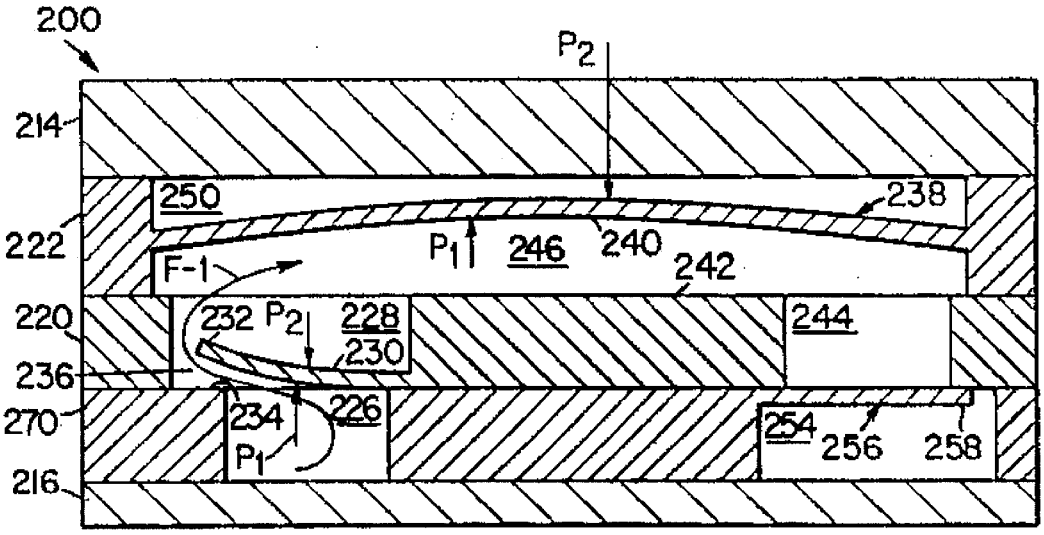
FIG. 6 is a first cross-sectional side view of a third embodiment of a plate-type diaphragm pump of the present invention, wherein the plate-type diaphragm pump is fully pressure-actuated, further wherein, in the view shown in FIG. 6, the inlet valve member and the diaphragm member are each open and the outlet valve member is closed.
Figure 7:
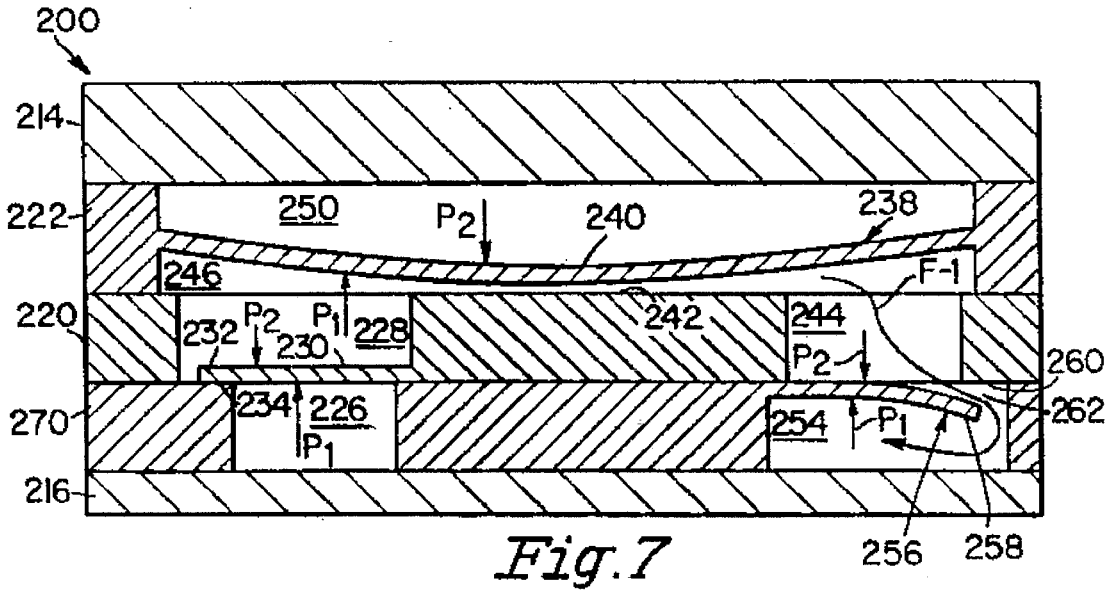
FIG. 7 is a second cross-sectional side view of the diaphragm pump shown in FIG. 6, wherein the inlet valve member and the diaphragm member are each closed and the outlet valve member is open.

FIGS. 6 and 7 represent a fully pressure-actuated pump within the scope of this invention, wherein the inlet valve member of the pump is open in FIG. 6 and closed in FIG. 7, and the outlet valve member is closed in FIG. 6 and open in FIG. 7.

In FIGS. 6 and 7, pump 200 contains first and second end-plates 214 and 216, a first inlet/outlet plate 270, a second inlet/outlet plate 220, and a diaphragm plate 222. Second inlet/outlet plate 270 has formed therein a first section 226 of an inlet channel 226/228 and a first valve-seat 234. First inlet/outlet plate 220 has formed therein a second section 228 of inlet channel 226/228 and a flexible inlet element 230 having a free end 232. First inlet/outlet plate 220 further has formed therein a first section 244 of an outlet channel 244/254 and a second valve-seat 260. Second inlet/outlet plate 270 further has formed therein a second section 254 of outlet channel 244/254 and a flexible outlet element 256 having a free end 258. Pump 200 further contains a diaphragm member 238 which is formed in a diaphragm plate 222. Diaphragm member has a deflectable portion 240 which is disposed for movement toward and away from a diaphragm-seat 242 which is a section of first inlet/outlet plate 220. Also formed in diaphragm plate 222 are two fluid chambers 246 and 250 which are separated from one another by diaphragm member 238. Chamber 246 is disposed between diaphragm member 238 and first inlet/outlet plate 220, while chamber 250 is disposed between diaphragm member 238 and first end-plate 214. Diaphragm-seat 242 is disposed in chamber 246 and preferably comprises the upper facial surface of plate 220.

First and second valve-seats 234 and 260 preferably comprise sections of the upper facial surface of plate 270.

In FIGS. 6 and 7, the first and second inlet channel sections 226 and 228, the flexible inlet element 230 and free end 232, and first valve-seat 234 make up an inlet valve member; while the first and second outlet channel sections 244 and 254, the flexible outlet element 256 and free end 258, and second valve-seat 260 make up an outlet valve member. Diaphragm plate 222 has formed therein a flexible diaphragm member 238 with a deflectable portion 240 and two fluid chambers 246 and 250 separated from each other by means of member 238. Deflectable portion 240 is disposed for movement toward and away from a diaphragm-seat 242.

Free end 232 of flexible inlet element 230 is disposed for movement onto and off of first valve-seat 234. When free end 232 is disposed off of first valve-seat 234 (as shown, e.g., in FIG. 6), flow of a fluid F-1 between inlet channel sections 226 and 228 is permitted via a passageway 236. When free end 232 is disposed on first valve-seat 234 (as shown, e.g., in FIG. 7), fluid flow between inlet channel sections 226 and 228 is prevented. Free end 258 of flexible outlet element 256 is disposed for movement onto and off of second valve-seat 260. When free end 258 is disposed off of second valve-seat 260 (as shown, e.g., in FIG. 7), fluid flow between outlet channel sections 244 and 254 is permitted via a passageway 262. When free end 258 is disposed on second valve-seat 260 (as shown, e.g., in FIG. 6), fluid flow between outlet channel sections 244 and 254 is prevented.

In FIG. 6, a first pressure P1 is applied against deflectable portion 240 to move the deflectable portion 240 toward end-plate 214 and away from diaphragm-seat 242. A second pressure P2, which in FIG. 6 is less than pressure P1 and in FIG. 7 is greater than pressure P1, may be exerted on deflectable portion 240 through chamber 250, e.g., by means of a second fluid (not shown) flowing in chamber 250. The movement of the deflectable portion 240 reduces the pressure between the inlet and outlet valve members such that free end 232 of flexible inlet element 230 moves away from first valve-seat 234 and fluid F-1 is permitted to flow from inlet channel section 226 to inlet channel section 228 via passageway 236 and then into chamber 246.

In FIG. 7, second pressure P2 is applied against deflectable portion 240 and causes deflectable portion 240 to move toward diaphragm-seat 242, which increases the pressure between the inlet and outlet valve members and causes the free end 232 of inlet element 230 to be moved onto first valve-seat 234 and the free end 258 of outlet element 256 to be moved off of second valve-seat 260, thereby permitting fluid F-1 to flow from channel section 244 to channel section 254 via passageway 262.

Figure 8:
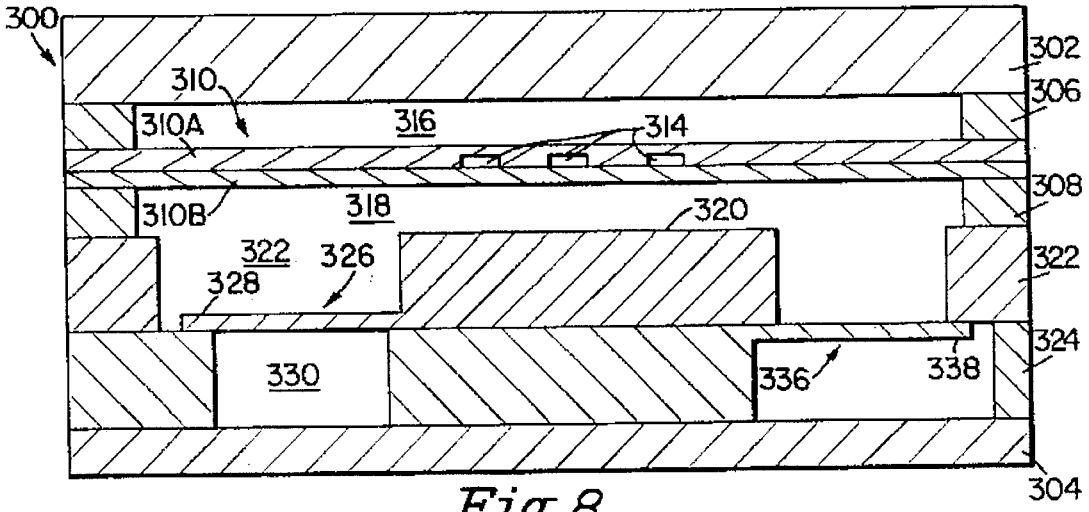
FIG. 8 is a first cross-sectional side view of a fourth embodiment of a plate-type diaphragm pump of this invention wherein the diaphragm pump is temperature-actuated and has heat exchange channels formed in a first diaphragm element formed in a composite diaphragm member.
Figure 9:
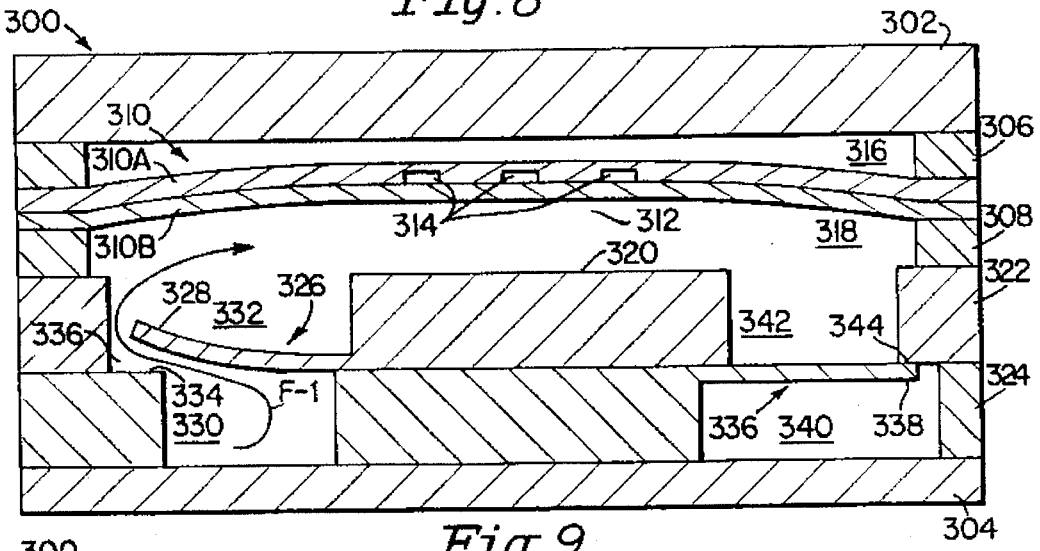
FIG. 9 is a second cross-sectional side view of the diaphragm pump shown in FIG. 8, wherein the inlet valve member and the diaphragm member are each open and the outlet valve member is closed.
Figure 10:
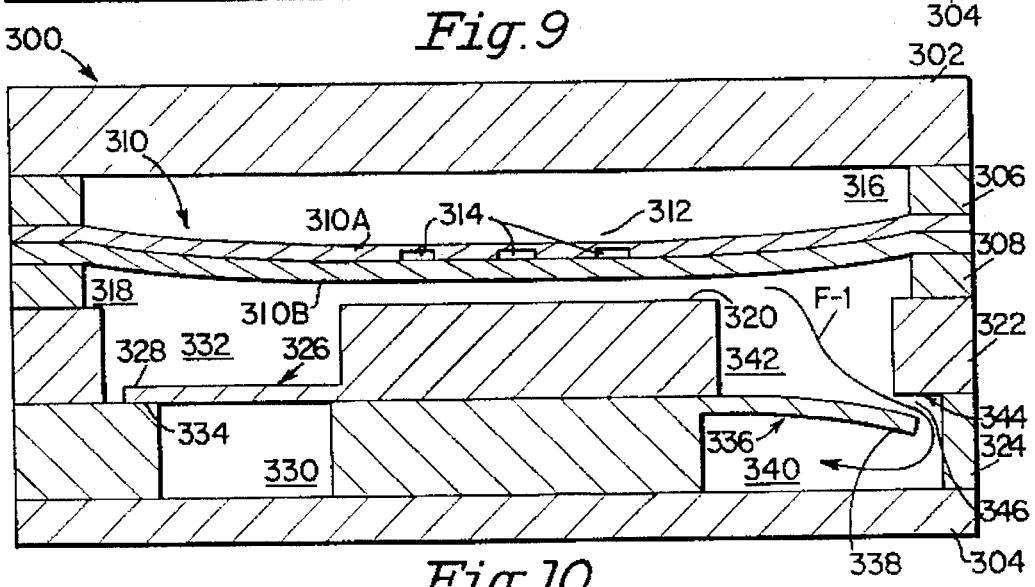
FIG. 10 is a third cross-sectional side view of the diaphragm pump shown in FIG. 8, wherein the inlet valve member and the diaphragm member are each closed and the outlet valve member is open.

FIGS. 8–10 illustrate a partially temperature-actuated, partially pressure-actuated embodiment of the pump within the scope of the present invention, wherein the pump is in a "stable" position in FIG. 8, the inlet valve member is open in FIG. 9 and closed in FIG. 10, and the outlet valve member is closed in FIG. 9 and open in FIG. 10.

Pump 300 is composed of first and second end-plates 302 and 304, first and second inlet/outlet plates 322 and 324, and first and second diaphragm plates 306 and 308. Second inlet/outlet plate 324 has formed therein a first section 330 of an inlet channel 330/332 and a first valve-seat 334. First inlet/outlet plate 322 has formed therein a second section 332 of inlet channel 330/332. First inlet/outlet plate 322 further has formed therein a first section 342 of an outlet channel 342/340 and a second valve-seat 344. Second inlet/outlet plate further has formed therein a second section 340 of outlet channel 342/340 and a flexible outlet element 336 having a free end 338. Pump 300 further contains a diaphragm composite member 310 which is a composite containing first and second diaphragm elements 310A and 310B attached to each other. Diaphragm element 310A is formed in a first diaphragm plate 306 and is equivalent to diaphragm member 38 as shown in FIG. 1, while diaphragm element 310B is formed in a second diaphragm plate 308. In addition, diaphragm composite member 310 preferably has formed therein heat exchange channels 314 through which a heat exchange fluid is passed to facilitate temperature change.

Diaphragm composite member 310 has a deflectable portion 312 which is disposed for movement toward and away from a diaphragm-seat 320 which is a section of first inlet/outlet plate 322. Also formed in diaphragm plate 306 is a fluid chamber 316, while a second fluid chamber 318 is formed in plate 308. Fluid chambers 316 and 318 are separated from one another by diaphragm composite member 310. Chamber 316 is disposed between diaphragm composite member 310 and first end-plate 302. Diaphragm-seat 320 is disposed in chamber 318 and preferably comprises the upper facial surface of plate 322.

First and second valve-seats 334 and 344 preferably comprise sections of the upper facial surface of plate 324.

Diaphragm element 310A is formed of a first material having a first thermal expansion coefficient and diaphragm element 310B is formed of a second material having a second thermal expansion coefficient which is different from the first thermal expansion coefficient. In FIGS. 8–10, heat exchange channels 314 are formed in diaphragm element 310A. Alternatively or additionally, one or more heat exchange channels can be formed in diaphragm element 310B.

In FIGS. 8–10, the first and second inlet channel sections 330 and 332, the flexible inlet element 326 and free end 328, and first valve-seat 334 make up an inlet valve member; while the first and second outlet channel sections 342 and 340, the flexible outlet element 336 and free end 338, and second valve-seat 344 make up an outlet valve member.

Free end 328 of flexible inlet element 326 is disposed for movement onto and off of first valve-seat 334. When free end 328 is disposed off of first valve-seat 334 (as shown, e.g., in FIG. 9), flow of a fluid F-1 between inlet channel sections 330 and 332 is permitted via a passageway 336. When free end 328 is disposed on first valve-seat 334 (as shown, e.g., in FIG. 10), fluid flow between inlet channel sections 330 and 322 is prevented. Free end 338 of flexible outlet element 336 is disposed for movement onto and off of second valve-seat 334. When free end 338 is disposed off of second valve-seat 334 (as shown, e.g., in FIG. 10), fluid flow between outlet channel sections 342 and 340 is permitted via a passageway 346. When free end 338 is disposed on second valve-seat 334 (as shown, e.g., in FIG. 9), fluid flow between outlet channel sections 342 and 340 is prevented.

In FIG. 8, elements 310A and 310B are maintained at a temperature wherein both elements have identical dimensions. Thus, deflectable portion 312 is disposed in a flat or "stable" position. In FIGS. 9 and 10, either or both of elements 310A and 310B are heated or cooled and the different thermal expansion coefficients of the materials making up the elements cause composite member 310 to be deflected toward one direction or the other. For example, if element 310B ends up with more expansion or less contraction than element 310A in response to a change in temperature, deflectable portion 312 is deflected upwardly away from diaphragm-seat 320, as shown in FIG. 9. On the other hand, if element 310A ends up with more expansion or less contraction than element 310B in response to a change in temperature, deflectable portion 312 is deflected downwardly toward diaphragm-seat 320, as shown in FIG. 10.

Although not shown in FIGS. 8–10, either or both of the flexible inlet element 326 and the flexible outlet element 336 may be a composite structure containing first and second sub-elements composed of materials differing in thermal expansion coefficients. Thus, the inlet and/or outlet element may be temperature-actuated in the same manner in which composite diaphragm member 310 is temperature-actuated. In addition, heat exchange channels like channels 314 may be formed in the composite inlet and/or outlet element to facilitate temperature change.

In the magnetic- and temperature-actuated embodiments of the pump of this invention, the inlet and outlet valve members and the diaphragm member can be independently opened or closed. In the fully pressure-actuated embodiments of the pump, the diaphragm member and the inlet and outlet valve members generally do not move independently of each other.

The pump may be used as a switching valve/pump apparatus since any switching combination is possible or the pump may be used as a manifold apparatus when all or nearly all valve and diaphragm members are opened.

Although the present invention has been described with reference to preferred embodiments, those skilled in the art will recognize that changes may be made in form and detail without departing from the spirit and scope of the invention.

What is claimed is:

1. A plate-type diaphragm pump, comprising:

an inlet valve-member containing: a first inlet plate structure containing a first valve-seat and an integral first section of an inlet channel; and a second inlet plate structure containing an integral second section of the inlet channel and a flexible inlet element disposed between said sections of said inlet channel, said inlet element having a free end disposed to move off of and onto the first valve-seat to respectively allow and prevent fluid flow through said inlet channel;

an outlet valve-member containing: a first outlet plate structure containing a second valve-seat and an integral first section of an outlet channel; and a second outlet plate structure containing an integral second section of the outlet channel and a flexible outlet element disposed between said sections of said outlet channel, said outlet element having a free end disposed to move off of and onto the second valve-seat to respectively allow and prevent fluid flow through said outlet channel; and a diaphragm member having a deflectable portion disposed for movement toward and away from a diaphragm-seat situated in a fluid chamber disposed between the diaphragm member and the inlet and outlet channels;

wherein said first inlet plate structure, said second inlet plate structure, said first outlet plate structure and said second outlet plate structure are each in the form of a plate or a plate section.

2. A pump according to claim 1, wherein said diaphragm member is formed in at least one diaphragm plate.

3. A pump according to claim 2, further comprising a first end-plate and a second end-plate, said first end-plate being disposed on said at least one diaphragm plate and said second end-plate being disposed on said first inlet plate structure and said second outlet plate structure.

4. A pump according to claim 3, wherein said second inlet plate structure is a first inlet plate section and said first outlet plate structure is a first outlet plate section, further wherein said first inlet plate section and said first outlet plate section together constitute a single first inlet/outlet plate.

5. A pump according to claim 4, wherein said first inlet plate structure and said second outlet plate structure are separate plates.

6. A pump according to claim 5, wherein said first end-plate and said at least one diaphragm plate each comprise a permanently or reversibly charged material.

7. A pump according to claim 6, wherein said first end-plate and said at least one diaphragm plate are charged to opposite polarities.

8. A pump according to claim 6, wherein said first end-plate and said at least one diaphragm plate are charged to like polarities.

9. A pump according to claim 6, wherein said first inlet/outlet plate, said first inlet plate, and said second outlet plate each comprise a permanently or reversibly charged material.

10. A pump according to claim 9, wherein said first end-plate and said at least one diaphragm plate are charged to opposite polarities; said at least one diaphragm plate and said first inlet/outlet plate are charged to opposite polarities; said first inlet plate and said first inlet/outlet plate are charged to like polarities; and said first inlet/outlet plate and said second outlet plate are charged to opposite polarities.

11. A pump according to claim 9, wherein said first end-plate and said at least one diaphragm plate are charged to like polarities; said at least one diaphragm plate and said first inlet/outlet plate are charged to opposite polarities; said first inlet plate and said first inlet/outlet plate are charged to opposite polarities; and said first inlet/outlet plate and said second outlet plate are charged to like polarities.

12. A pump according to claim 4, wherein said first inlet plate structure is a second inlet plate section and said second outlet plate structure is a second outlet plate section, further wherein said second inlet plate section and said second outlet plate section together constitute a single second inlet/outlet plate.

13. A pump according to claim 2, wherein said diaphragm member comprises a single diaphragm element which is integral with and cantilevered onto a first diaphragm plate.

14. A pump according to claim 2, wherein said diaphragm member comprises a composite containing a first diaphragm element and a second diaphragm element attached to each other in a face-to-face configuration, wherein said first diaphragm element is integral with a first diaphragm plate and contains a first material having a first thermal expansion coefficient, and said second diaphragm element is non-integral with said first diaphragm plate and contains a second material having a second thermal expansion coefficient.

15. A pump according to claim 14, wherein said second diaphragm element is integral with a second diaphragm plate, said second diaphragm plate being facially adjacent and attached to said first diaphragm plate and disposed between said first diaphragm plate and said diaphragm-seat.

16. A pump according to claim 15, wherein said diaphragm member has one or more heat exchange channels formed therein.

17. A pump according to claim 16, wherein said one or more heat exchange channels are formed by an etching process.

18. A pump according to claim 15, wherein either or both of the flexible inlet element and the flexible outlet element comprises a composite containing a first sub-element and a second sub-element attached to each other in a face-to-face configuration, wherein said first sub-element contains a first material having a first thermal expansion coefficient, and said second sub-element contains a second material having a second thermal expansion coefficient.

19. A pump according to claim 1, wherein said flexible inlet element is integral with and cantilevered onto said second inlet plate structure and said flexible outlet element is integral with and cantilevered onto said second outlet plate structure, further wherein said flexible inlet element and said flexible outlet element are formed in said second inlet plate structure and said second outlet plate, respectively, by an etching process.

20. A pump according to claim 2, wherein said inlet channels, said outlet channels, said fluid chamber and said diaphragm member are formed by an etching process.

21. A pump according to claim 2, wherein said inlet plates, said outlet plate structures and said at least one diaphragm plate structure each have a thickness of from about 0.001 inch to about 1.0 inch.

22. A method of controlling fluid flow by means of a plate-type diaphragm pump comprising:

an inlet valve-member containing: a first inlet plate structure containing an integral first section of an inlet channel and a first valve-seat; and a second inlet plate structure containing an integral second section of the inlet channel and a flexible inlet element disposed between said sections of said inlet channel, said inlet element having a free end disposed to move off of and onto the first valve-seat to respectively allow and prevent fluid flow through said inlet channel;

an outlet valve-member containing: a first outlet plate structure containing an integral first section of an outlet channel and a second valve-seat; and a second outlet plate structure containing an integral second section of the outlet channel and a flexible outlet element disposed between said sections of said outlet channel, said outlet element having a free end disposed to move off of and onto the second valve-seat to respectively allow and prevent fluid flow through said outlet channel; and a diaphragm member having a deflectable portion disposed for movement toward and away from a diaphragm-seat situated in a fluid chamber disposed between the diaphragm member and the inlet and outlet channels;

wherein said first inlet plate structure, said second inlet plate structure, said first outlet plate structure and said second outlet plate structure are each in the form of a plate or a plate section;

wherein said method comprises the steps of:

introducing a first fluid into the first section of the inlet channel; and inducing a first actuating force sufficient to cause: the deflectable portion of the diaphragm member to move away from the diaphragm-seat, the free end of the flexible inlet element to move off of the first valve-seat, and the free end of the flexible outlet element to move onto the second valve-seat, so as to cause the first fluid to flow through the inlet channel and into the fluid chamber; and inducing a second actuating force sufficient to cause: the deflectable portion of the diaphragm member to move toward the diaphragm-seat, the free end of the flexible inlet element to move onto the first valve-seat, and the free end of the flexible outlet element to move off of the second valve-seat, so as to cause the first fluid to flow from the fluid chamber through the outlet channel.

23. A method according to claim 22, wherein said diaphragm member is formed in at least one diaphragm plate.

24. A method according to claim 23, wherein said pump further comprises a first end-plate and a second end-plate, said first end-plate being disposed on said at least one diaphragm plate and said second end-plate being disposed on said first inlet plate structure and said second outlet plate.

25. A method according to claim 24, wherein said second inlet plate structure is a first inlet plate section and said first outlet plate structure is a first outlet plate section, further wherein said first inlet plate section and said first outlet plate section together constitute a single first inlet/outlet plate.

26. A method according to claim 25, wherein said first inlet plate structure and said second outlet plate structure are each plates.

27. A method according to claim 26, wherein said first end-plate and said at least one diaphragm plate each comprise a permanently or reversibly charged material.

28. A method according to claim 27, wherein said first inlet/outlet plate, said first inlet plate, and said second outlet plate each comprise a permanently or reversibly charged material.

29. A method according to claim 28, wherein said first end-plate and said diaphragm plate are charged to opposite polarities; said diaphragm plate and said first inlet/outlet plate are charged to opposite polarities; said first inlet plate and said first inlet/outlet plate are charged to like polarities; and said first inlet/outlet plate and said second outlet plate are charged to opposite polarities.

30. A method according to claim 28, wherein said first end-plate and said diaphragm plate are charged to like polarities; said diaphragm plate and said first inlet/outlet plate are charged to opposite polarities; said first inlet plate and said first inlet/outlet plate are charged to opposite polarities; and said first inlet/outlet plate and said second outlet plate are charged to like polarities.

31. A method according to claim 25, wherein said first inlet plate structure is a second inlet plate section and said second outlet plate structure is a second outlet plate section, further wherein said second inlet plate section and said second outlet plate section together constitute a single second inlet/outlet plate.

32. A method according to claim 24, wherein said diaphragm member comprises a single diaphragm element which is integral with and cantilevered onto a first diaphragm plate.

33. A method according to claim 24, wherein said diaphragm member comprises a composite containing a first diaphragm element and a second diaphragm element attached to each other in a face-to-face configuration, wherein said first diaphragm element is integral with a first diaphragm plate and contains a first material having a first thermal expansion coefficient, and said second diaphragm element is non-integral with said first diaphragm plate and contains a second material having a second thermal expansion coefficient.

34. A method according to claim 33, wherein said second diaphragm element is integral with a second diaphragm plate, said second diaphragm plate being facially adjacent and attached to said first diaphragm plate and disposed between said first diaphragm plate and said diaphragm-seat.

35. A method according to claim 34, wherein said diaphragm member has one or more heat exchange channels formed therein.

36. A method according to claim 35, wherein said one or more heat exchange channels are formed by an etching process.

37. A method according to claim 33, wherein either or both of the flexible inlet element and the flexible outlet element comprises a composite containing a first sub-element and a second sub-element attached to each other in a face-to-face configuration, wherein said first sub-element contains a first material having a first thermal expansion coefficient, and said second sub-element contains a second material having a second thermal expansion coefficient.

38. A method according to claim 22, wherein said flexible inlet element is integral with and cantilevered onto said second inlet plate structure and said flexible outlet element is integral with and cantilevered onto said second outlet plate structure, further wherein said flexible inlet element and said flexible outlet element are formed in said second inlet plate structure and said second outlet plate structure, respectively, by an etching process.

39. A method according to claim 24, wherein said inlet channels, said outlet channels, said fluid chamber and said diaphragm member are formed by an etching process.

40. A method according to claim 24, wherein said inlet plate structures, said outlet plate structures and said at least one diaphragm plate each have a thickness of from about 0.001 inch to about 1.0 inch.

* * * * *